US008517201B2

(12) United States Patent
Triquet et al.

(10) Patent No.: US 8,517,201 B2
(45) **Date of Patent: *Aug. 27, 2013**

(54) HEAT-SEALABLE INNER SEAL FOR SEALING A CONTAINER

(75) Inventors: Stephane Triquet, Ecully (FR); Remy Bischoff, Limas (FR)

(73) Assignee: Manufacture Generale de Joints, Chazay d'Azergues (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/536,427

(22) Filed: Jun. 28, 2012

(65) Prior Publication Data

US 2013/0032598 A1 Feb. 7, 2013

Related U.S. Application Data

(63) Continuation of application No. 13/285,166, filed on Oct. 31, 2011, now Pat. No. 8,225,954.

(30) Foreign Application Priority Data

Aug. 1, 2011 (FR) ..... 11 57057

(51) Int. Cl.
*B65D 17/34* (2006.01)

(52) U.S. Cl.
USPC .... 220/359.2; 29/592; 229/123.1; 229/123.2; 220/254.1; 220/258.2; 220/270; 220/276; 220/359.3; 220/359.4; 215/232; 215/250; 215/258; 215/347; 215/349

(58) Field of Classification Search
USPC ..... 220/254.1, 258.2, 270, 276, 359.2, 220/359.3, 359.4; 215/232, 250, 258, 347, 215/349; 29/592; 229/123.1, 123.2
See application file for complete search history.

(56) References Cited

U.S. PATENT DOCUMENTS

| | | | | |
|---|---|---|---|---|
| 4,754,890 | A | 7/1988 | Ullman et al. | |
| 8,225,954 | B1 * | 7/2012 | Triquet et al. | 220/359.2 |
| 2009/0078671 | A1 | 3/2009 | Triquet et al. | |

FOREIGN PATENT DOCUMENTS

| | | | |
|---|---|---|---|
| CA | 2019501 | A1 | 12/1990 |
| FR | 2716407 | A1 | 8/1995 |
| GB | 2330134 | A | 4/1999 |
| JP | 2000191021 | A | 7/2000 |
| WO | 2010115811 | A1 | 10/2010 |

* cited by examiner

*Primary Examiner* — Anthony Stashick
*Assistant Examiner* — Elizabeth Volz
(74) *Attorney, Agent, or Firm* — Tech Valley Patent, LLC; John Pietrangelo

(57) ABSTRACT

Heat-sealable seal including a support bonded to an inner seal by a temporary adhesive is provided. The inner seal has a pull-tab which is folded back once on the surface of the inner seal in contact with the corresponding surface of the support. The inner seal includes a laminate having a reinforcing layer and a sheet of a conducting material, to the lower surface of which is applied a heat-sealing film. The temporary adhesive is applied to the whole surface of the inner seal once the pull-tab is folded back. The seal is characterized in that the laminate has over its entire thickness a notch from which the pull-tab emerges, and a fold line formed by the pull-tab once the pull-tab is folded back, the fold line having a shorter length than the length of the notch. Methods of producing the seal are also disclosed.

20 Claims, 3 Drawing Sheets

HEAT-SEALABLE INNER SEAL FOR SEALING A CONTAINER

CROSS-REFERENCE TO RELATED APPLICATION

This application is a continuation application of application Ser. No. 13/285,166 filed on Oct. 31, 2011, now U.S. Pat. No. 8,225,954, which claims priority from French patent application FR 1157057, filed on Aug. 1, 2011, the disclosures of which are included by reference herein in their entirety.

BACKGROUND

1. Field of the Invention

The invention relates to a new pull-tab seal intended to seal a container with a plug or cap closure and the production method thereof.

2. Description of Related Art

Containers with a plug or cap closure are made leak-tight, before they are first opened, by means of a seal which may be bonded or sealed, particularly heat-sealed, on the mouth of the container.

The invention relates more specifically to a heat-sealable seal. Such a seal comprises an inner seal set in place over the entire periphery of the upper edge of the neck of the container or mouth, thereby isolating the container from the outside, and on the other hand, a generally thicker support, inserted into, but without being bonded to, the bottom of the plug. Prior to the first opening of the container, the support and the inner seal may be bonded by means of a temporary adhesive.

The function of the inner seal is first of all to make the container tamper-proof prior to the first opening. Additionally, it provides primary leak tightness with regards to the outside. Moreover, it has to develop certain compatibility properties with the contents that it is supposed to isolate and for example be of food grade quality if the recipient contains food.

The support, for its part, is intended to absorb the tolerances between the bottom of the cap and/or plug and the upper part of the neck of the container, and additionally, to provide secondary leak-tightness if the inner seal has been fully or partly removed. It is therefore able to provide a certain memory-effect compression precisely so as to absorb these tolerances.

In practice, the seal is inserted inside the cap or plug. Once the container is filled, the plug or cap fitted with the seal is screwed or snapped onto the container. The inner seal part of the seal is then in contact with the mouth of the container. The inner seal is then sealed on the mouth of the container by heat-sealing induction. Said heat-sealing is made possible by the combined action of a layer of conductive material inserted in the seal, which heats up under the effect of electrical induction, causing the sealing film to soften and to bond to the mouth. The conductive material is inserted in the thickness of the inner seal. When the container is opened for the first time, the support inserted inside the plug separates from the inner seal which remains sealed onto the mouth. It is only afterwards that the inner seal is removed by the consumer, the leak-tightness, in the closed position of the container, then being only provided by the compression of support of the seal on the mouth.

In order to provide an inner seal that can be effectively and easily torn off by the consumer, an easy-grasp pull-tab has been added to said inner seal, as described for example in document FR-A-2 716 407.

Nonetheless, the presence of this protuberant pull-tab makes it difficult to place the seal inside the plug or cap, because of the resulting over-thickness along the edge of the seal. It is furthermore difficult to place the pull-tab safely relative to the thread or to the clips arranged in the plug or cap so as to prevent any risk of damage to the pull-tab at the time of closing or opening the plug or cap.

Prior art document DE3920324 describes an induction heat-sealable seal comprising a support and an inner seal fitted with a pull-tab, the support and the inner seal being at no time bonded to one another. Of three embodiments shown, only one of them (FIG. 1) comprises a pull-tab folded back over its entire surface. Said pull-tab is formed by associating a membrane and a heat sealable layer, the aluminum foil being in the support.

Document JP 2000-191021 describes a seal made up of a support and an inner seal joined by means of a temporary adhesive. The seal contains a pull-tab which is either folded back over the support or hangs along the mouth.

Document U.S. Pat. No. 4,754,890 describes an inner seal and a support which are never joined by means of a temporary adhesive.

Document GB 2 330 134 describes a seal wherein the support and an inner seal are bonded by means of a wax layer. This seal has a pull-tab which is folded back, with the heat-sealing layer of the pull-tab being between the support and the inner seal.

Prior art document EP 2 045 194 A1 describes a seal that comprises a support and an inner seal fitted with a pull-tab. Support and inner seal are bonded by means of a temporary adhesive applied to the inner seal, after the pull-tab has been folded back. In a first embodiment, the pull-tab solely comprises a reinforcing layer with no heat-sealing layer. In this case, delamination of the layers constituting the inner seal may occur when the seal is peeled off. In a second embodiment, the pull-tab comprises an aluminum layer and exhibits an S-shape when it is folded back. The presence of these two folds definitely increases the thickness of the pull-tab which makes temporary assembly of the inner seal and the support quite difficult.

Document WO 2010/115811 describes a seal of the same type as above. When the pull-tab contains an aluminum layer, it systematically comprises a heat-sealing layer on its lower surface. To prevent the bonding of the sealing layer to the lower surface of the support at the moment of induction, the heat-sealing layer is advantageously coated with an anti-adhesive film. Such an embodiment increases the number of layers and the cost of production. At the same time, in the preferred embodiment, the pull-tab comprises a reinforcing layer adjacent to the sealing layer, said pull-tab being devoid of a heat-sealing layer and folded back over an aluminum foil.

Even if the seals proposed in the prior art provide some worthwhile solutions, there are still a number of problems to be resolved and in particular:

- the layers constituting the inner seal may delaminate upon peeling off said inner seal when the pull-tab is not formed in the entire thickness of the inner seal, the mechanical strength of the pull-tab may be more or less strong depending on the nature and number of layers constituting the inner seal,
- when the pull-tab is provided with heat-sealing film, the pull-tab may bond to the support at the time of induction,
- when the sheet of a conductive material is included in the pull-tab, the seal under the pull-tab at the moment of induction may be too weak, making it necessary to increase the induction power and therefore to reduce the possible induction temperature range when sealing, and the rigidity of the inner seal with respect to its thickness, which is generally greater than 200 micrometers, the manufacturing method which still requires a relatively high number of steps that also affect the production cost.

BRIEF SUMMARY OF ASPECTS OF THE INVENTION

To overcome all these difficulties, the Applicant has developed a new seal including an inner seal having a pull-tab. The resulting inner seal is such that its shape enables to incorporate a sheet of a conducting material into said pull-tab. As a result, the sealing of the seal to the mouth of the container is sufficient and not weakened. It therefore becomes possible to fold back all the layers constituting the inner seal, including the aluminum foil, with the exception of the heat-sealing layer. As a consequence, delamination may be avoided, the pull-tab resistance is strengthened and the production method facilitated.

To be more specific, the subject matter of the invention is a heat-sealable seal that includes a support bonded to an inner seal by means of a temporary adhesive, said inner seal having a pull-tab the entire surface of which is folded back once over the surface of the inner seal in contact with the corresponding surface of the support, the inner seal comprising a laminate including a reinforcing layer and a sheet of a conducting material, to the lower surface of which is applied a heat-sealing film, the temporary adhesive being applied to the whole surface of the inner seal once the pull-tab is folded back.

The seal is characterized in that the laminate has over its entire thickness a notch from which the pull-tab emerges, the fold formed by the pull-tab once it is folded back being shorter in length than the notch.

In other words, the base of the pull-tab is offset to the rear relative to the periphery of the heat-sealing film. That means that the area, outside the pull-tab, of the laminate is smaller than the surface of the heat-sealing film. As a result, the laminate does not cover the heat-sealing film in its entirety. As already said, the laminate includes the reinforcing layer and a sheet of a conducting material.

To be more specific, the combination of a notch created in the reinforcing layer/sheet of a conducting material laminate and a pull-tab whereof the length of the fold is narrower and smaller than the length of the notch makes it possible to reduce as far as possible, i.e., the distance between the fold, once the pull-tab is folded back, and the periphery of the heat-sealing film. This gives the advantage of creating lesser disturbance in the induced field, thereby guaranteeing a homogeneous seal of all the layers on the mouth as well as a wider induction temperature range.

As already stated, the pull-tab emerges from the notch created in the laminate which means that the pull-tab emerges from the entire thickness of the laminate. In other words, the pull tab may comprise the same number of layers as the number of layers constituting the laminate. Apart from the aforementioned induction-related advantages, it means further that delamination of the layers constituting the laminate can be avoided, pull-tab resistance can be improved and the pull-tab does not bond with the support (the lower surface of the pull-tab is devoid of heat-sealing film).

In a preferred embodiment, the inner seal consists exclusively of the laminate, the lower surface of the laminate being in contact with the heat-sealing film.

The inner seal can also comprise, on the upper side of the laminate, additional layers, such as, a reinforcing film which is not included in the tab. The presence of this extra layer may not affect the sealing of the heat sealable seal.

Similarly, according to one aspect of the invention, the heat-sealing film may be applied to the underside of the laminate. In a preferred embodiment, the film is directly applied to the underside of the laminate, regardless of the presence of a binder layer applied between the laminate and the heat sealable layer. As a result, the layers constituting the laminate do not delaminate upon peeling off the inner seal. In a non-preferred alternative embodiment, at least one distinct intermediate layer is applied between the laminate and the heat-sealing film. This intermediate layer may not be a binder, but it can be a reinforcing film. In this case, the tab may not include this additional layer. Although, delamination between the laminate and the additional layer might occur, this embodiment still solves the sealing issues of the prior art.

To prevent incipient tears in the pull-tab when the inner seal is peeled off, the notch comprises at each of its ends a hollow area facing outward from the inner seal.

Advantageously, each hollow area has a radius of curvature of between 0.3 and 5 mm, and advantageously between 0.5 and 2 mm.

According to an aspect of the invention, the fold is formed at the junction of the pull-tab itself and the notch. The notch has in practice a length of between 3 and 15 mm, and advantageously between 5 and 10 mm. The notch has, for its part, and advantageously, a length of between 3 and 25 mm, and preferably between 3.6 and 20 mm.

According to an aspect of the invention, the pull-tab itself comprises two parts, a base and a grasp area respectively. The base may have curvilinear or rectilinear lateral edges or a succession of curvilinear and/or rectilinear edges. Regardless of embodiment that is chosen, the distance separating the lateral edges in this area is smaller than the length of the fold. In a preferred embodiment, the opposite lateral edges of the base have a hollow outward facing shape. The grasp area may be of any shape, and particularly of a general circular shape. Advantageously, the distance separating the two opposite lateral edges of the pull-tab is greater than the length of the fold.

In a general way, the sheet of a conducting material is made in the form of an aluminum foil or the equivalent.

In another embodiment, the pull-tab includes a laminate comprising an upper reinforcing layer/sheet of a conducting material/lower reinforcing layer, the two reinforcing layers being plastic films of the same chemical type. Clearly, the upper and lower reinforcing layers may themselves comprise a plurality of films. In this case, at least the two outermost films are of the same chemical type.

The Applicant has noted that said construction, or structure, would make it possible to bring into contact with the temporary adhesive two surfaces of the same chemical type, in this case, the upper plastic reinforcing layer and the lower plastic reinforcing layer once the pull-tab is folded back. The adhesion force between the temporary adhesive and the reinforcing layers must be as weak as possible so as to facilitate separation between the inner seal and the support at the time of opening, without however there being any risk of separation prior to the seal being put in place on the mouth, i.e. particularly during transportation of the seal. The fact that these two films are of the same chemical type means further that a homogeneous adhesion force is provided between the temporary adhesive and the surface of the inner seal, including the surface of the pull-tab once folded back. This strength must also be smaller than the adhesion force of the inner seal onto the mouth after induction.

According to an aspect of the invention, one, the other, or both reinforcing layers may be printed. In particular, the printing of the lower reinforcing layer allows the pull-tab to be clearly distinguished on the upper surface of the inner seal, once the pull-tab is folded back. In a general way, the material constituting the reinforcing layer is chosen in such a way that the resistance of said material is greater than that of the inner seal tear-off force. In practice, the reinforcing layers are for example bi-oriented polyester films, with a thickness of between 6 and 40 μm.

In the embodiment according to which the aluminum foil is set between two reinforcing layers, said reinforcing layers are advantageously made of polyethylene terephthalate (PET), generally temperature-resistant.

According to another feature, the heat-sealing film is made of a material of the polyolefin type, selected from the group that includes polyethylene, polypropylene or PET, of the hot-melt type or of the terpolymer or ionomer type. In a general way, the material constituting the heat-sealing film is selected with respect to the type of container.

The heat-sealing film can be a monolayer film that is extruded on the underside of the laminate. The heat-sealing film can also be a two-layer film comprising a lower heat-sealing layer and an upper bonding layer, that is applied to the underside of the laminate by co-extrusion.

Depending on their kind and on the manufacturing process implemented, all the layers constituting the inner seal may be joined by means of a binder, such as a bi-component isocyanate-hydroxil adhesive, for example.

The inner seal has, in practice, a thickness of between 20 and 200 μm, and preferably between 30 and 120 μm.

The support may be made of any type of recovery memory compressible material, particularly of expanded polyethylene or expanded polypropylene, possibly comprising on at least one of its two surfaces, a polypropylene or polyethylene film to give it a degree of rigidity. It may also be made of paper or cardboard. In practice, the support has a thickness of between 0.5 and 4 mm, and advantageously between 0.8 and 2 mm.

As regards to the temporary bonding between the support and the inner seal, this may be obtained by means of a temporary adhesive applied in the form of a film, preferably extruded or co-extruded, each of the two surfaces of the layer having a different adhesive power, the most adhesive surface being applied to the lower surface of the support, whereas the least adhesive surface is applied to the upper surface of the inner seal. In practice, such a film is based on a polymer, generally synthetic, and carefully selected by those skilled in the art, in order to obtain the required differential bonding properties. Such polymers are for example polymers or copolymers based on acetate, acrylate, polyethylene, etc. The temporary adhesive may also come in the form of a layer of wax.

A further object of the invention is a method of producing the heat-sealable seals previously described. The inventive method includes the following steps:

- a laminate is prepared that includes a reinforcing layer and a sheet of a conducting material,
- in register, a pull-tab pre-cut is made in the laminate extending at its base by means of a notch in such a way that the length of the fold of the pull-tab once folded back is shorter than that of the notch,
- the surface of the pull-tabs in its entirety is folded back once mechanically on the upper surface of the laminate,
- the lower surface of the laminate is then bonded permanently with the heat-sealing film, the assembly constituting the inner seal strip,
- at the same time, a support strip is prepared,
- the support strip is then temporarily bonded to the inner seal by means of a temporary adhesive, to form the seal strip,
- the seals are cut out of the entire thickness of the seal strip to the required shape in register with the pull-tabs.

In a known way, the support strip is produced by associating films or foam of support-constituting materials, particularly those described previously. In a preferred embodiment, the laminate comprises successively an upper reinforcing layer, a sheet of a conducting material and a lower reinforcing layer.

By implementing the pull-tab in the entire thickness of the laminate, additional steps can be overcome, at the time of production, and particularly the preparation of a different laminate, associating aluminum and heat-sealing film for example, which would not be part of the pull-tab.

According to one aspect of the invention, the heat-sealing film is advantageously extruded or co-extruded on the lower surface of the laminate.

BRIEF DESCRIPTION OF THE DRAWINGS

The invention and the resulting advantages will become clearer from the following examples, supported by the appended figures.

DETAILED DESCRIPTION OF ASPECTS OF THE INVENTION

The invention lies in the combination, in a seal (support+inner seal), of a specific pull-tab shape, the presence of aluminum in said pull-tab and the absence of heat-sealing layer still in the pull-tab.

Figure 1:
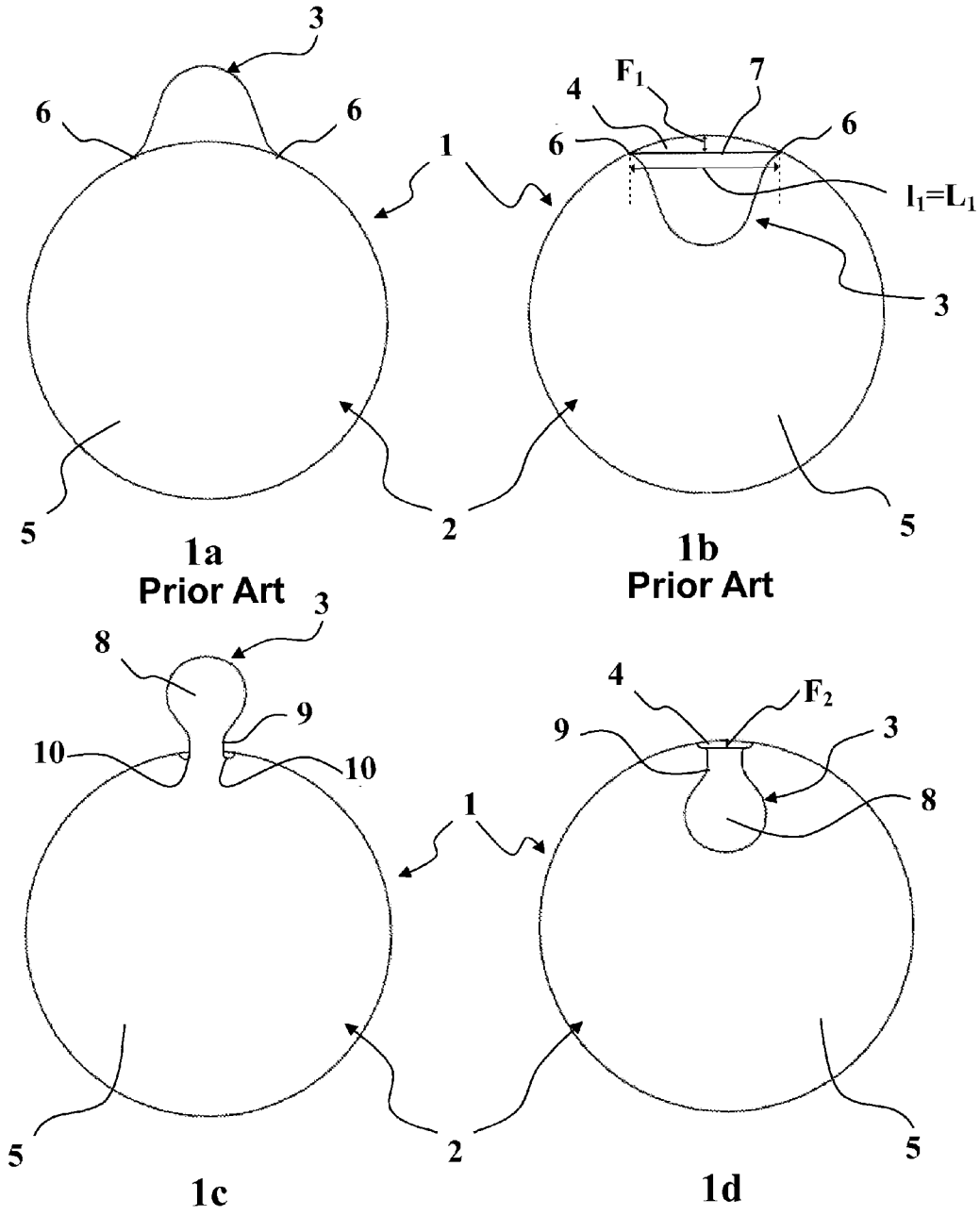
FIG. 1 is a view shown from above of the inner seal according to the invention, and particularly its pull-tab as compared with prior art inner seals, the pull-tab being unfolded (1*a*, 1*c*) or folded back (1*b*, 1*d*).

FIG. 1 relates more specifically to the shape of the pull-tabs of the inner seal. FIGS. 1*a* and 1*b* show the shape of known prior art pull-tabs while FIGS. 1*c* and 1*d* relate to the shape of the pull-tab in a preferred embodiment of the invention.

The inner seals are referred to generally each time as 1. They each include the inner seal itself (2) generally circular in shape and the pull-tab (3). The inner seals more specifically comprise a heat-sealing film (4) and an aluminum/upper reinforcing layer laminate (5).

FIGS. 1*b*, 1*d* are used to distinguish between the two elements of heat-sealing film (4) and laminate (5) after the pull-tab (3) is folded. However, the exact structure of the (upper backing/aluminum) laminate cannot be seen in these figures. More specifically, in FIG. 1*a*, the heat-sealing film (4) and the laminate (5) are superimposed and therefore have the same surface. In this case, the pull-tab originates at the periphery (6) of the inner seal and is extended directly outward from the inner seal. The length ($l_1$) of the fold (7) when folding is therefore in this case equal to the distance ($L_1$) separating the two ends (6) of the pull-tab. As shown in FIG. 1*b*, the arrow ($F_1$) is long which means there can be no satisfactory sealing of the heat-sealing film without increasing the induction power.

Figure 2:
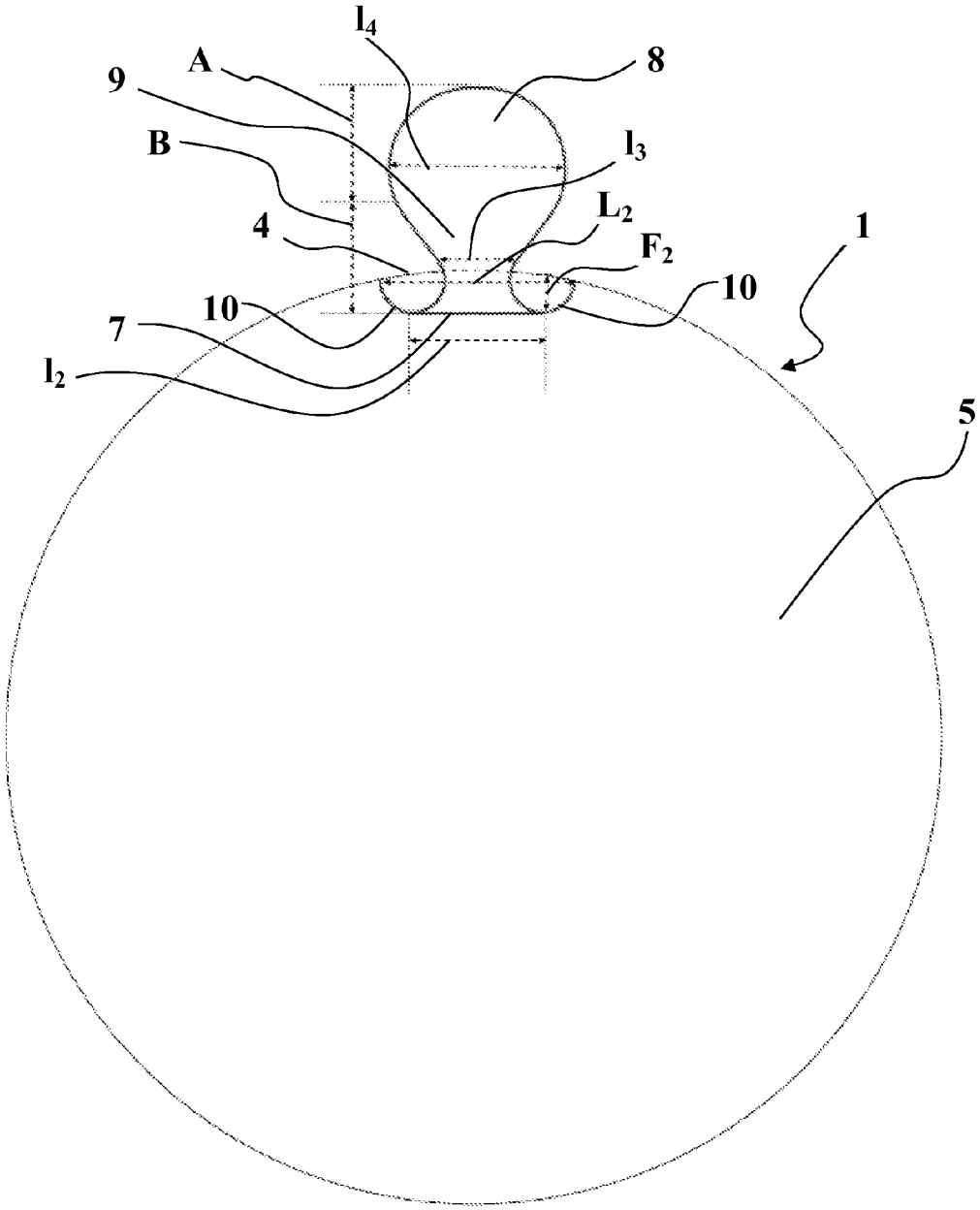
FIG. 2 is another embodiment of the pull-tab shown in FIG. 1*c*.

In FIGS. 1*c* and 1*d*, a preferred shape of the inventive inner seal has been shown. The pull-tab itself shown in FIG. 2 comprises a grasp area (8) of length A and a base (9) of length B. The base (9) of the pull-tab emerges from a flared notch (10) in outward facing hollows, made in the laminate (5), by definition set back relative to the periphery of the heat-sealing film (4). The fold (7) is formed tangentially at the junction between the notch (10) and the base (9). As is clear from these figures, the fold (7) has a length ($l_2$) which is shorter than the length ($L_2$) of the notch (10). This means, after the pull-tab is folded back, that the length $F_2$ is provided of shorter length relative to the length $F_1$ in FIG. 1*b* showing the prior art. According to the embodiment shown in FIG. 2, the opposite lateral edges of the base (9) have an outward facing hollow shape such that the distance ($l_3$) separating the two lateral edges is smaller than the length ($l_2$) of the fold. This configuration promotes the resistance of the pull-tab when the inner seal is torn off. To give a good grasp, the distance $l_4$ separating two opposite edges of the grasp area is greater than the distance $l_2$ of the fold (7).

Figure 3:
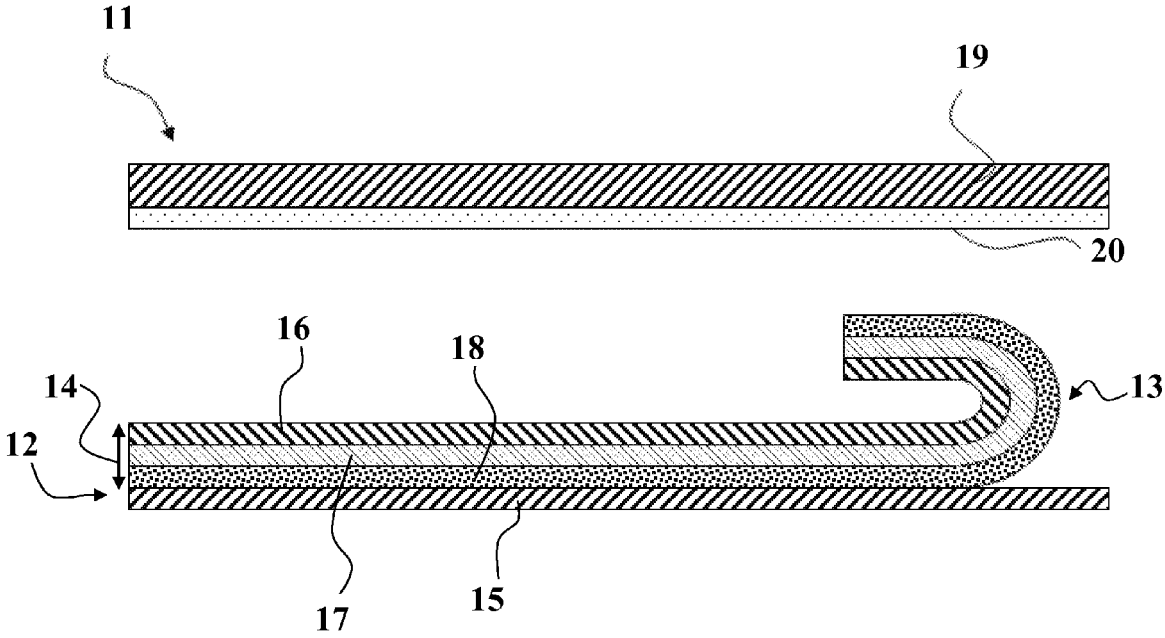
FIG. 3 is a cross-section view of the seal according to the invention, prior to the inner seal part being bonded to the support part according to a preferred embodiment.

In FIG. 3 a cross-section has been shown of an inventive seal in a preferred embodiment. The seal defined in this figure comprises a support (11) and an inner seal (12) having a pull-tab (13). The inner seal comprises two elements, a laminate (14) and a heat-sealing film (15) respectively. The laminate (14) itself comprises an upper reinforcing layer (16), an aluminum foil (17) and a lower reinforcing layer (18). The two reinforcing layers are made of PET, i.e. are of the same chemical type.

This then allows two chemically identical surfaces to be provided in contact with the temporary adhesive, the effect of which is to:

- control the bonding force of the temporary adhesive on the inner seal in a homogeneous manner between the surface part of the inner seal and the folded back pull-tab part,
- provide sufficient adhesion force between the temporary adhesive and the surface of the inner seal, including the folded back pull-tab part, so as to cause the inner seal and the support to separate with no risk of damage to the assembly.

The heat-sealing film (15) which for its part is made of polyethylene and applied to the lower surface of the laminate (14) by extrusion or co-extrusion. The total thickness of the inner seal is about 100 micrometers.

The support includes a layer (19) made of expanded polypropylene or polyethylene and has a thickness of between 1.4 and 1.7 mm.

As shown in this figure, the pull-tab (13) has no heat-sealing layer (15) and is arranged set back relative to the end of the heat-sealing layer, which equates to the depth of the notch (10) made in the laminate (14). Once folded back, the pull-tab (13) comes into contact with the layer of temporary adhesive (20) applied to the lower surface of the support (11).

The temporary adhesive comes in the form of an extruded film of the polyethylene type, each of the two surfaces of the film having a different bonding power, the most adhesive surface being applied to the lower surface of the support, whereas the least adhesive surface is applied to the upper surface of the inner seal.

In practice, these seals are positioned as they are at the bottom of the plug, the plug then being screwed or snapped, depending on the circumstances, onto the neck of the container. The seal is induction heat-sealed.

As regards the method, the first thing to be produced is the inner seal. To do so, a strip of upper reinforcing layer/aluminum foil/lower reinforcing layer laminate is prepared. In register, a pull-tab pre-cut is made in this laminate extending at its base by means of a notch in such a way that the length of the fold of the pull-tab once folded back is shorter than that of the notch. The surface of the pull-tabs in its entirety is then folded back once mechanically on the upper surface of the laminate. The heat-sealing film is then extruded on the lower surface of the laminate, the assembly constituting the inner seal strip. At the same time, a support strip is prepared. The support strip is then temporarily bonded to the inner seal by extrusion of the temporary adhesive, to form the seal strip. The seals are cut out of the entire thickness of the seal strip to the required shape in register with the pull-tabs.

The invention and the resulting advantages are clear from the preceding description. Particularly notable is the advantage of making a pull-tab seal of specific shape containing an aluminum foil and with no heat-sealing film, the pull-tab being folded back in the entire thickness of the seal, so as to:

- avoid the risk of delamination of the layers constituting the inner seal when it is torn off,
- promote adhesion by advantageously bringing layers of the same type into contact, and
- facilitate the method.

The invention claimed is:

1. A heat-sealable inner seal having a pull-tab folded back once over a surface of the inner seal, the inner seal comprising a laminate comprising the pull-tab, the laminate including a reinforcing layer and a sheet of a conducting material, and wherein a heat-sealing film is applied to a lower surface of the laminate, wherein after the pull-tab is folded back, the folded pull-tab exposes at least a portion of the heat-sealing film and defines a fold line positioned at a distance ($F_2$) from a periphery of the heat-sealing film and having a length ($l_2$) less than a chord length of the laminate at the distance ($F_2$) from the periphery of the heat-sealing film.

2. The inner seal as claimed in claim 1, wherein the inner seal consists exclusively of the laminate and the heat-sealing film.

3. The inner seal as claimed in claim 1, wherein the laminate comprises an upper reinforcing layer and a lower reinforcing layer, wherein each of the upper reinforcing layer and the lower reinforcing layer comprises a plastic film of a same chemical type, and wherein the sheet of the conducting material is positioned between the upper reinforcing layer and the lower reinforcing layer.

4. The inner seal as claimed in claim 3, wherein the upper reinforcing layer and the lower reinforcing layer are made of PET.

5. The inner seal as claimed in claim 1, wherein the length ($l_2$) of the fold line is between 3 and 15 mm.

6. The inner seal as claimed in in claim 5, wherein the length ($l_2$) is between 5 and 10 mm.

7. The inner seal as claimed in claim 1, wherein the pull-tab comprises a base and a grasp area, wherein the base includes a distance ($l_3$) between lateral edges of the base that is smaller than the length ($l_2$) of the fold line.

8. The inner seal as claimed in claim 7, wherein the grasp area comprises a distance ($l_4$) between two opposite lateral edges of the grasp area, and wherein the distance ($l_4$) is greater than the length ($l_2$) of the fold line.

9. The inner seal as claimed in claim 1, wherein the laminate further comprises a notch in a periphery of the laminate from which the pull-tab projects.

10. The inner seal as claimed in claim 9, wherein the fold line comprises a length ($l_2$) shorter than a length ($L_2$) of the notch.

11. The inner seal as claimed in claim 10, wherein the length of the notch ($L_2$) is between 3 and 25 mm.

12. The inner seal as claimed in in claim 11, wherein the length ($L_2$) is between 3.6 and 20 mm.

13. The inner seal as claimed in claim 9, wherein the notch comprises a first end and a second end, opposite to the first end, and wherein the first end and the second end each include a hollow area facing outward from the inner seal, each hollow area having a radius of curvature of between 0.3 and 5 mm.

14. The inner seal as claimed in claim 13, wherein the radius of curvature is between 0.5 and 2 mm.

15. A method of producing a heat-sealable inner seal from an inner seal strip, the inner seal strip having a pull-tab folded back once over a surface of the inner seal, the inner seal strip comprising a heat-sealing film and a laminate strip, the laminate strip including a reinforcing layer and a sheet of a conducting material, the method comprising:

providing a pull-tab in the laminate strip;

folding the pull-tab over upon a surface of the laminate strip to produce a folded pull-tab and a fold line positioned at a distance ($F_2$) from a periphery of the heat-sealing film, the fold line having a length ($l_2$) less than a chord length of the laminate at the distance ($F_2$), and wherein the folding exposes at least a portion of the heat-sealing film;

applying a heat-sealing film to a surface of the laminate strip opposite the folded pull-tab to provide the inner seal strip comprising the laminate strip with folded pull-tab and the heat-sealing film, wherein at least the portion of the heat-sealing film is exposed through the laminate strip; and making the inner seal by cutting the inner seal strip to a required shape.

16. A heat-sealable inner seal for a container comprising:

a laminate comprising a reinforcing layer and a sheet of conducting material;

a heat-sealing film positioned to contact the container; and a tab comprising the laminate projecting from a periphery of the laminate;

wherein, when the tab is folded over onto a surface of the laminate, at least a portion of the heat-sealing film is exposed and a fold line is formed having a length ($l_2$) positioned at a distance (F2) from a periphery of the heat-sealing film; and wherein the length ($l_2$) of the fold line is less than a chord length of the laminate at the distance ($F_2$) from the periphery of the heat-sealing film.

17. The inner seal as claimed in claim 16, wherein the inner seal consists exclusively of the laminate and the heat-sealing film.

18. The inner seal as claimed in claim 16, wherein the laminate further comprises a recess in a periphery of the laminate from which the pull-tab projects.

19. The inner seal as claimed in claim 16, wherein the laminate comprises an upper reinforcing layer and a lower reinforcing layer, wherein each of the upper reinforcing layer and the lower reinforcing layer comprises a plastic film of a same chemical type, and wherein the sheet of the conducting material is positioned between the upper reinforcing layer and the lower reinforcing layer.

20. The inner seal as claimed in claim 19, wherein the upper reinforcing layer and the lower reinforcing layer are made of PET.

* * * * *